US008998780B2

(12) United States Patent
Lewen

(10) Patent No.: US 8,998,780 B2
(45) Date of Patent: Apr. 7, 2015

(54) FITNESS EQUIPMENT

(71) Applicant: Michael Stanley Lewen, Lakewood, CO (US)

(72) Inventor: Michael Stanley Lewen, Lakewood, CO (US)

( * ) Notice: Subject to any disclaimer, the term of this patent is extended or adjusted under 35 U.S.C. 154(b) by 148 days.

(21) Appl. No.: 13/834,413

(22) Filed: Mar. 15, 2013

(65) Prior Publication Data

US 2014/0274569 A1 Sep. 18, 2014

(51) Int. Cl.
*A63B 21/00* (2006.01)
*A63B 7/02* (2006.01)
*A63B 21/055* (2006.01)

(52) U.S. Cl.
CPC ..... *A63B 7/02* (2013.01); *A63B 21/0552* (2013.01)

(58) Field of Classification Search
USPC ..... 482/124, 121, 51, 122; 601/33, 23
See application file for complete search history.

(56) References Cited

U.S. PATENT DOCUMENTS 5,993,362 A * 11/1999 Ghobadi ..... 482/124

* cited by examiner

*Primary Examiner* — Jerome w Donnelly
(74) *Attorney, Agent, or Firm* — McClure, Qualey & Rodack, LLP

(57) ABSTRACT

The disclosed fitness equipment allows a user to target different muscle groups using tri-planar coordination of movement, which was previously difficult (if not impossible) to achieve using conventional suspension training equipment. This is done by providing a resistance between suspension training straps, namely, by mechanically coupling an elastic band between the suspension training straps.

17 Claims, 3 Drawing Sheets

FITNESS EQUIPMENT

BACKGROUND

1. Field of the Disclosure

The present disclosure relates generally to exercise and, more particularly, to fitness and training equipment.

2. Description of Related Art

Given a host of health problems that can arise from a relatively-sedentary lifestyle and improper exercising techniques, there is a renewed interest in personal fitness and preventative healthcare. Consequently, there is now an abundance of fitness equipment, such as treadmills, stair-climbers, stationary bicycles, etc. Even with so many pieces of fitness equipment on the market, there are ongoing efforts to provide better equipment.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION OF THE EMBODIMENTS

Figure 1:
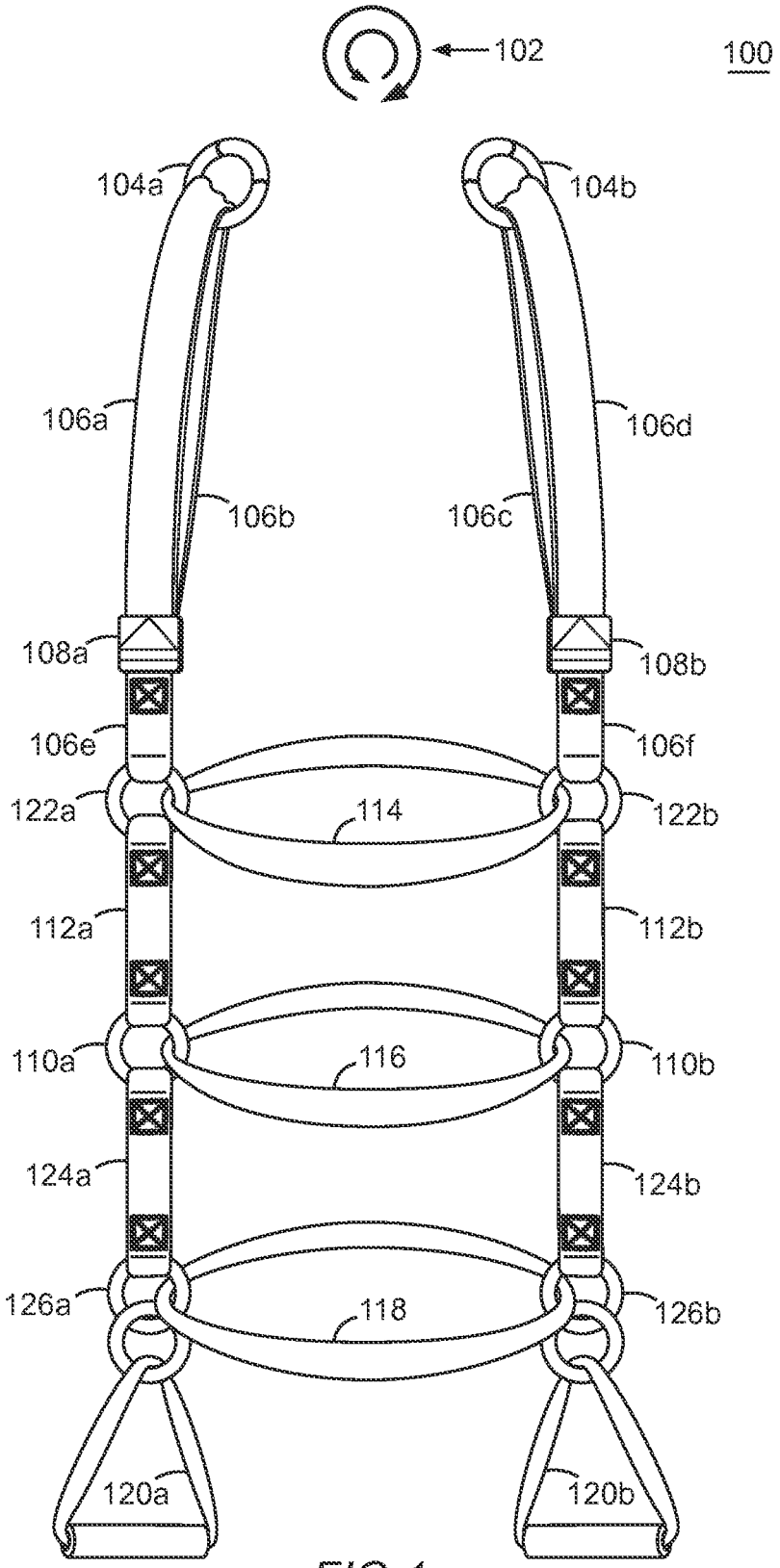
FIG. 1 is a diagram showing one embodiment of the fitness equipment.

Fitness equipment, such as treadmills, stair-climbers, stationary bicycles, etc. are ubiquitously present. Fitness equipment also comes in simpler varieties, such as exercise mats, exercise balls, jump ropes, and suspension training equipment. Irrespective of the type of equipment, the focus is usually on targeting discrete muscle groups. By way of example, conventional suspension training equipment (e.g., gymnastic rings, TRX training equipment, etc.) permits training of different muscle groups through different types of exercises. However, since the only acting force on a suspension trainer is gravity, the counteracting motion is usually a two-dimensional force applied counter to the gravitational force. Consequently, this results in movement that is largely confined to a single plane of motion. Thus, for those that use suspension training equipment, it is virtually impossible to realize tri-planar resistance (or resistance through all three planes of motion, namely, sagittal, transverse, and frontal). In other words, suspension training equipment usually provides resistance for only a single plane of motion. Thus, conventional suspension training equipment usually requires multiple different exercises in order to effectively the various muscle groups.

The disclosed fitness equipment (hereafter abbreviated as "Space Trainer") overcomes the shortcomings of conventional suspension training equipment by incorporating resistance training. Thus, the Space Trainer allows a user to target different muscle groups using tri-planar coordination of movement, which was previously difficult (if not impossible) to achieve using conventional suspension training equipment. The resistance is provided by mechanically coupling an elastic resistance band between suspension training straps. Also, by making modular the pieces of the Space Trainer, greater versatility is provided to the user.

Having provided a general overview of the Space Trainer, reference is now made in detail to the description of the embodiments as illustrated in the drawings. While several embodiments are described in connection with these drawings, there is no intent to limit the disclosure to the embodiment or embodiments disclosed herein. On the contrary, the intent is to cover all alternatives, modifications, and equivalents.

Description of the Space Trainer

FIG. 1 is a diagram showing one embodiment of the Space Trainer 100. As shown in FIG. 1, the Space Trainer 100 comprises a left strap, a right strap, and one or more elastic bands 114, 116, 118 that are mechanically coupled between the left strap and the right strap.

The left strap comprises a left upper segment 106*a*, 106*b*, 106*e*, a left middle segment 112*a*, and a left lower segment 124*a*. The left strap comprises an adjuster 108*a* that is located on the left upper segment 106*a*, 106*b*, 106*e*, which permits adjustment of the length of the left strap. The embodiment of FIG. 1 shows the upper segment 106*a*, 106*b* being mechanical attached to a fastener 104*a*, such as a karabiner. As described below, the fastener 104*a* is used to mechanically attach and suspend the left strap from an anchor (not shown in FIG. 1). The left upper segment 106*e* is mechanically coupled to the left middle segment 112*a* by an insertion connector 122*a*, which is shown as a ring or loop in FIG. 1. The left middle segment 112*a* is, in turn, mechanically coupled to the left lower segment 124*a* by another insertion connector 110*a*. The Space Trainer 100 further comprises a left handle 120*a*, which is mechanically coupled to the left lower segment 124*a* by one or more insertion connectors 126*a*. It should be appreciated by those having skill in the art that, in a preferred embodiment, the connectors 122*a*, 110*a*, 126*a* may be removable, thereby making the left strap modular. In other words, the length of the left strap can be adjusted by either removing one or more segments 112*a*, 124*a*, or by adjusting the length of the left upper segment 106*a*, 106*b* using the adjuster 108*a*.

Similar to the left strap, the right strap comprises a right upper segment 106*c*, 106*d*, 106*f*, a right middle segment 112*b*, and a right lower segment 124*b*. The right strap comprises an adjuster 108*b*, which permits adjustment of the length of the right strap. The right strap also comprises a fastener 104*a*. The right upper segment 106*f* is mechanically coupled to the right middle segment 112*b* by an insertion connector 122*b*. The right middle segment 112*b* is, in turn, mechanically coupled to the right lower segment 124*b* by another insertion connector 110*b*. The Space Trainer 100 further comprises a right handle 120*b*, which is mechanically coupled to the right lower segment 124*b* by one or more insertion connectors 126*b*. Again, it should be appreciated by those having skill in the art that, in a preferred embodiment, the connectors 122*a*, 110*a*, 126*a* may be removable, thereby making the right strap modular.

For the embodiment of FIG. 1, an upper elastic band 114 is mechanically connected between the left upper segment 106*e* and the right upper segment 106*f* through their respective insertion connectors 122*a*, 122*b* (collectively 122). Preferably, the upper elastic band 114 is a stiff band that is difficult to stretch. As shown in FIG. 1, a middle elastic band 116 is mechanically connected between the left middle segment 112*a* and the right middle segment 112*b* through their respective insertion connectors 110*a*, 110*b* (collectively 110). Preferably, the middle elastic band 116 is more elastic than the upper elastic band 114. Lastly, a lower elastic band 118 is mechanically connected between the left lower segment 124*a* and the right lower segment 124*b* through their respective insertion connectors 126*a*, 126*b* (collectively 126). Preferably, the lower elastic band 118 is more elastic than either the upper elastic band 114 or the middle elastic band 116. In other words, the elasticity of the bands 114, 116, 118 increases as the band get closer to the handle. In a preferred embodiment, the lower elastic band 118 is situated in close proximity to the handles 120*a*, 120*b* (collectively 120).

The elastic bands 114, 116, 118 provide varying levels of resistance between the right strap and the left strap. Thus, unlike conventional suspension training equipment, the Space Trainer 100 permits tri-planar resistance, thereby allowing a user to target more muscle groups than possible through a single plane of motion.

To the extent that the left strap and the right strap function as the suspension component, while the elastic bands 114, 116, 118 function to provide resistance between the straps, the straps are preferably inelastic. Thus, in a preferred embodiment, the middle segments 112*a*-112*b* (collectively 112) and lower segments 124*a*-124*b* (collectively 124) are approximately one (1) to two (2) inches wide, approximately ten (10) to twenty (20) inches in length, and comprise industrial grade nylon webbing with heavy-gauge nylon stitching that allow for the insertion of the connectors 122, 110, 126. The upper segments 106*a*-106*f* also comprise industrial grade nylon. However, unlike the middle segments 112 and the lower segments 124, the upper segment 106 is approximately six (6) to approximately eight (8) feet in length, thereby allowing the upper segments 106 to have somewhere between approximately three (3) to four (4) feet of variability when adjusted.

The handles 126 are preferably constructed using a polyvinylchloride (PVC) tube for the grip, which is threaded with ¾-inch nylon webbing. As such, the handles 126 can serve as either grips (for hands) or stirrups (for feet).

Figure 2A:
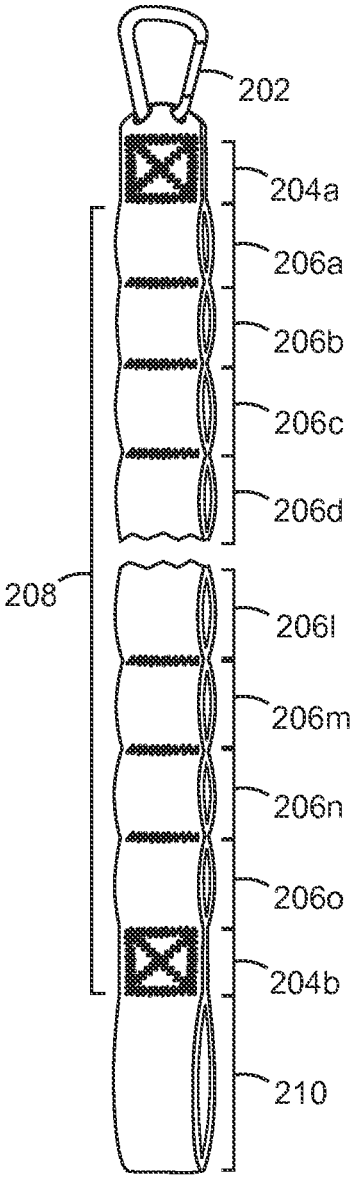
FIGS. 2A and 2B are diagrams showing one embodiment of an anchor.
Figure 2B:
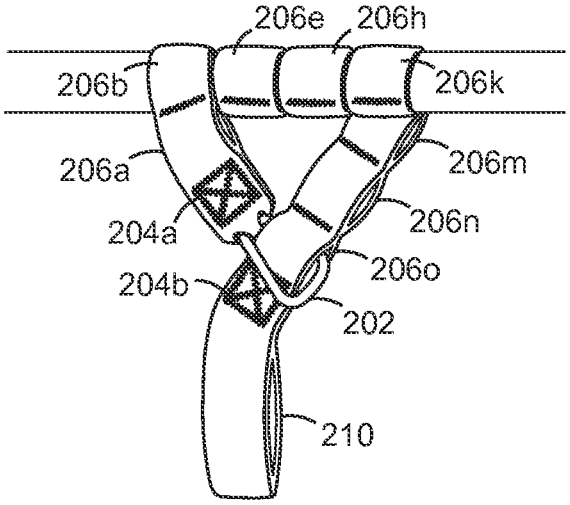

Also, to the extent that the Space Trainer provides suspension training, the left fastener 104*a* and the right fastener 104*b* are used to suspend the straps from an anchor, one embodiment of which is shown with reference to FIGS. 2A and 2B. As shown in FIG. 2A, one embodiment of the anchor comprises a heavy-duty fastener 202, such as a karabiner, which is mechanically attached to a length of heavy-gauge nylon webbing 208. In a preferred embodiment, the webbing 208 is double-stitched near the fastener 202 to maintain structural integrity. Also, preferably, the webbing 208 is approximately 1 to 2 inches wide, and approximately two (2) feet in length, with reinforcement stitches at regular intervals 206*a*-206*o* (collectively 206), for example, at approximately every three (3) inches. A loop 210 is formed at the bottom of the anchor. This loop 210 is used to secure the fasteners 104*a*, 104*b* (collectively 104) so that the straps (FIG. 1) can be suspended from the anchor.

FIG. 2B shows one embodiment of how the anchor can be installed. As shown in the embodiment of FIG. 2B, the anchor is secured to a horizontal bar or other mechanism by winding the anchor about the bar and securing the heavy-duty fastener 202 to one of the regular intervals 206 formed by the reinforcement stitches.

Figure 3:
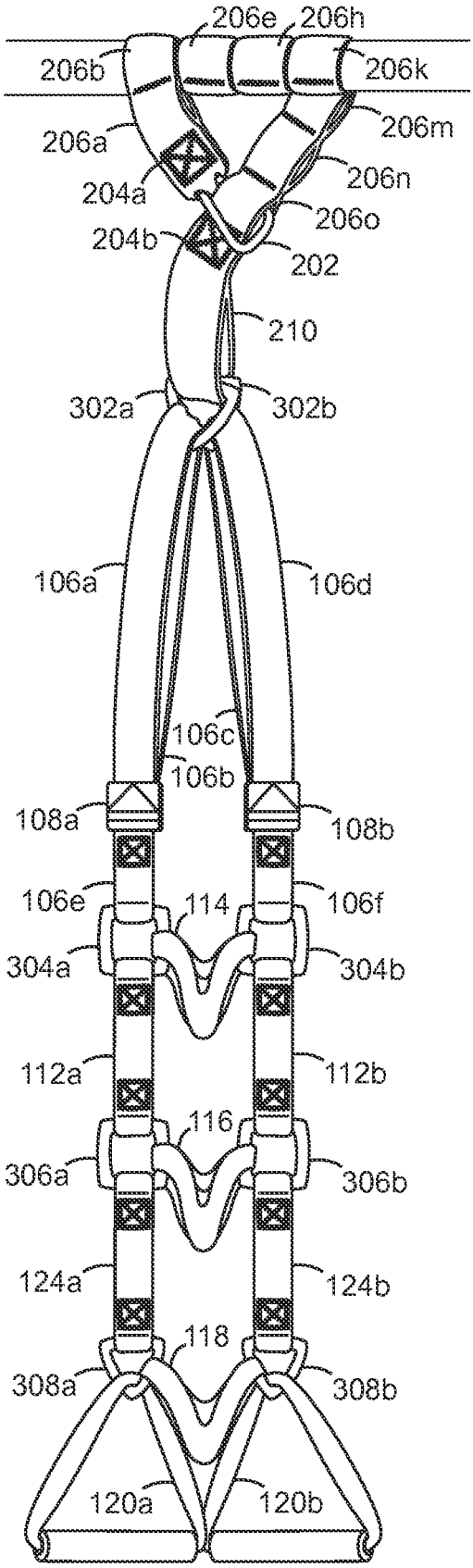
FIG. 3 is a diagram showing another embodiment of the fitness equipment.

With this in mind, attention is turned to FIG. 3, which is a diagram showing one embodiment of the fitness equipment having the straps (FIG. 1) secured to the anchor (FIGS. 2A and 2B). As shown in FIG. 3, this embodiment of the Space Trainer comprises an anchor 206, which is secured to a horizontal bar by a heavy-duty fastener 202, such as a karabiner. A loop 210 at the end of the anchor is used to secure insertion connectors 302*a*, 302*b* (collectively 302). Unlike FIG. 1, the insertion connectors 302 in FIG. 3 are triangular in shape. However, it should be appreciated that any shape can be used for the insertion connectors 302.

The upper segments of the straps 106 are secured to the anchor 206 through their respective insertion connectors 302. The upper segments 106 are in turn mechanically attached to their respective middle segments 112 through square insertion connectors 304*a*, 304*b* (collectively 304). Again, it should be appreciated that, while square insertion connectors 304 are shown, connectors of any shape can be used to achieve substantially the same function. The middle segments 112 are, in turn, mechanically secured to the lower segments 124 by another set of square insertion connectors 306*a*, 306*b* (collectively 306). At the end of the lower segments 124, handles 120 are attached. Similar to FIG. 1, elastic bands 114, 116, 118 are mechanically coupled between the straps to provide resistance elements.

It is worthwhile to note that, while three segments (upper, middle, lower) are shown with reference to FIGS. 1 through 3, the Space Trainer 100 also permits the user to remove one or more segments (e.g., middle segment, lower segment, or both) to provide a more versatile apparatus. Furthermore, while FIGS. 1 through 3 show three elastic bands 114, 116, 118 with varying levels of resistance, it should be appreciated that any combination of these bands may be used (e.g., only one band, two bands, all three bands, etc.). Additionally, while the embodiments of FIGS. 1 through 3 show the elastic bands 114, 116, 118 being placed in order of elasticity, it should be appreciated that the elastic bands 114, 116, 118 can be placed in any order, depending on the preference of the user or the exercise level that is desired.

From the embodiments of FIGS. 1 through 3, one can readily see that the Space Trainer 100 permits tri-planar coordinated movement by providing: (a) suspension components in one direction of motion; and (b) resistance components in another direction of motion that is substantially normal to the suspension direction. With this tri-planar mechanism in mind, some of the advantages and use of the Space Trainer 100 are provided below.

Advantages and Uses of the Space Trainer

Conventional suspension training equipment (e.g., gymnastic rings, TRX suspension training, etc.) does not have variable resistance bands 114, 116, 118. As such, conventional suspension training equipment largely provides for training in a single plane of movement.

Unlike conventional suspension training equipment, the Space Trainer combines body-weight suspension training and stability with continuous, variable band resistance in opposing vectors of motion that alternate and engage differently through concentric and eccentric phases of any given exercise in regards to, for example, internal and external rotational components of ancillary movement through long bones during dynamic movement (similar to the movement that one experiences in real life activities). This design allows for movements and exercises to pass through all three planes of motion (transverse, sagittal, frontal), simultaneously or independently, through a single exercise, which would otherwise call for multiple arrangements and sequences of two dimensional exercises to equal the same amount of muscle activation, muscle firing, metabolic equivalents, motor coordination and degree of functionality.

The blend of resistance and suspension training, along with tri-planar coordination of movement, creates a dynamic rotational stabilization effect that is allows for both eccentric and concentric phases of motion, which translates directly to measurable biomechanics and motor control. Benefits and uses of the Space Trainer include: (a) an increase in the number of individual muscles activated and fired to perform movement, which reduces and balances the total tension applied over the joint and increases metabolic rates; (b) minimal to zero impact sustained by joints and soft tissue during exercises; (c) proper neuromuscular control of stabilizing muscles and primary movers during movement patterns to reduce individual muscle strain as a result of dysfunctional or absent muscle stabilizers firing; (d) versatility in transportation and exercise options for home or travel use; (e) adjustable band resistance for different exercise levels and exercise program progressions; (f) adjustable suspension trainer portion with bilateral or unilateral use of handles for increased exercise options; and (g) full body workout adaptability, simultaneously between the axial skeleton with upper and lower extremities inclusion.

The Space Trainer also allows for varying degrees of resistance by combining different elastic bands 114, 116, 118 with varying degrees of elasticity. Since these bands 114, 116, 118 can be removed and used independently of suspension component (e.g., anchor (FIGS. 2A and 2B), straps (FIG. 1)), the Space Trainer can be configured for strength training, on one hand, and also for corrective and rehabilitative exercise training commonly practiced in physiotherapy disciplines, on the other hand. For example, a vast majority of chronic or non-traumatic shoulder injuries or shoulder impingement syndromes usually stem from excessive anteriority (or forward rounding) in the shoulder girdle. These types of problems likely result from poor posture, everyday repeated biomechanical activities, etc. Consequently, physical therapy techniques usually aim to stabilize the scapula during the movements incorporating the shoulder girdle by training and activating the surrounding posterior chain muscles. Strong scapular stabilization reduces imbalanced joint space pressures and promotes full mechanical range of motion of the glenohumeral joint.

Previously, linear method of this training or rehabilitation would normally require up to a dozen or more different exercises to isolate and train the inhibited muscles of the posterior chain in order to reduce pressure placed on the anterior aspect of the soft tissue of the shoulder joint. Those linear, isolated approaches were time-consuming and instruction-intensive because the exercises were performed sequentially and independently of each other. Consequently, this increased the room for error, thereby increasing the possibility for further injury or dysfunctions. The reason being that it is difficult to combine absolute functional motion with movements occurring independently in single movement planes void of rotational transitions and coordinated muscle firing patterns.

By contrast, the Space Trainer permits training of the scapular stabilizers of the shoulder through standing biceps curls and/or standing back rows to reduce impingement of the bicipital-labral complex and restores adequate sub-acromial space. For example, standing bicep curls begins with the patient facing the Space Trainer with supination of the palms while holding the handles 120, extending the elbows with the shoulders flexed to ninety degrees. As the biceps curl is initiated, the adductive forces of the band 118 provide a resistance prior to bicep flexion. This resistance affects scapular retraction and depression (or anatomical positioning of the shoulder blades) concomitantly with humeral external rotation through posterior shoulder cuff activation, followed by a concentric phase of the bicep curl which naturally includes further external rotation of the humerus, elbow flexion and wrist supination. As an eccentric phase is initiated, internal humeral rotation is counteracted and controlled, with concentric contraction of scapular stabilizers during muscle lengthening phases of the bicep, which usually requires more stability and control than the concentric phase.

The next exercise example, standing back rows, begins with the patient facing the Space Trainer with a neutral grip or palms facing, while holding the handles 120, extending the elbows and flexing the shoulders to a natural support (relative to foot placement under the anchor 210) and maintaining hip extension. As the back row is initiated, adductor forces of the band 118 provide a bicep flexion and humeral external rotational resistance while extending the humerus, flexing the elbow and supinating the wrists through the concentric phase. The initial bicep flexion and humeral external rotation resistance affects the stabilizing sequence of the scapula with respect to thoracic spine extension, at end range. Once the eccentric phase of the standing back row begins, motor firing of internal rotators of the humerus, serratus anterior and pectoralis major and minor engage to promote and assist in scapular retraction and depression, which relieves aberrant pressures at the anterior glenorhumeral joint that can cause pain and/or movement dysfunctions.

The Space Trainer promotes an increase in eccentric phase control though the use of more muscles (as compared to greater exertion), which is important since a majority of muscle strains are experienced during eccentric loading.

Any process descriptions or blocks in flow charts should be understood as representing modules, segments, or portions of code which include one or more executable instructions for implementing specific logical functions or steps in the process, and alternate implementations are included within the scope of the preferred embodiment of the present disclosure in which functions may be executed out of order from that shown or discussed, including substantially concurrently or in reverse order, depending on the functionality involved, as would be understood by those reasonably skilled in the art of the present disclosure.

Although exemplary embodiments have been shown and described, it will be clear to those of ordinary skill in the art that a number of changes, modifications, or alterations to the disclosure as described may be made. For example, while heavy-gauge nylon webbing is described as the preferred material, it should be appreciated that other suitable materials may be used to manufacture the Space Trainer. Also, while the straps are described to be inelastic, it should be appreciated that, for some training exercises, the straps may indeed be elastic (to a certain degree), thereby permitting even more variability for the user. Moreover, while specific shapes and dimensions are provided for the components of the Space Trainer, it should be appreciated that these shapes and dimensions are only for illustrative purposes. For example, while a triangular karabiner (or other releasable clip) is described, it should be appreciated that other types of removable clips (such as those found on key rings) can be used without detrimentally affecting the form and function of the Space Trainer. Furthermore, while the preferred embodiments of FIGS. 1 and 3 show two (2) separate straps (left and right), it should be appreciated that the left strap and the right strap can be a single strap that is folded in half at the anchor to make the left side be the left strap and the right side be the right strap. All such changes, modifications, and alterations should therefore be seen as within the scope of the disclosure.

What is claimed is:

1. An apparatus for providing suspension and resistance training, the apparatus comprising:

an anchor;

a left strap, comprising:

a left upper segment mechanically fastened to the anchor;

a left middle segment mechanically fastened to the left upper segment; and a left lower segment mechanically fastened to the left middle segment;

a left handle fastened to the left lower segment;

a right strap, comprising:

a right upper segment mechanically fastened to the anchor;

a right middle segment mechanically fastened to the right upper segment; and a right lower segment mechanically fastened to the right middle segment;

a right handle fastened to the right lower segment;

a first elastic band mechanically connected between the left upper segment and the right upper segment;

a second elastic band mechanically connected between the left middle segment and the right middle segment; and a third elastic band mechanically connected between the left lower segment and the right lower segment.

2. The apparatus of claim 1:

the right strap having a length, the right strap comprising a right adjuster, the right adjuster to adjust the length of the right strap; and the left strap having a length, the left strap comprising a left adjuster, the left adjuster to adjust the length of the left strap.

3. The apparatus of claim 1:

the second elastic band having a greater elasticity than the first elastic band; and the third elastic band having a greater elasticity than the second elastic band.

4. An apparatus, comprising:

an anchor;

a left strap mechanically coupled to the anchor, the left strap being inelastic;

a left handle mechanically coupled to the left strap;

a right strap mechanically coupled to the anchor, the right strap being inelastic:

a right handle mechanically coupled to the right strap; and a first elastic band mechanically coupled between the left strap and the right strap.

5. The apparatus of claim 4, the anchor comprising a karabiner.

6. The apparatus of claim 4, the anchor comprising heavy gauge nylon.

7. The apparatus of claim 4:

the left strap comprising a left upper segment, a left middle segment, and a left lower segment; and the right strap comprising an upper segment, a right middle segment, and a right lower segment.

8. The apparatus of claim 4:

the left strap comprising heavy gauge nylon; and the right strap comprising heavy gauge nylon.

9. The apparatus of claim 7, the first elastic band being mechanically coupled between the left lower segment and the right lower segment.

10. The apparatus of claim 7, the first elastic band being mechanically coupled between the left upper segment and the right upper segment, the apparatus further comprising:

a second elastic band mechanically coupled between the left middle segment and the right middle segment; and a third elastic band mechanically coupled between the left lower segment and the right lower segment.

11. The apparatus of claim 10:

the second elastic band having a greater elasticity than the first elastic band; and the third elastic band having a greater elasticity than the second elastic band.

12. An apparatus, comprising:

a left strap comprising an upper segment and a lower segment;

a right strap comprising an upper segment and a lower segment, the upper segment of the right strap being mechanically coupled to the upper segment of the left strap; and an elastic band mechanically coupled between the lower segment of the left strap and the lower segment of the right strap; and a second elastic band mechanically coupled between the left strap and the right strap, the second elastic band being less elastic than the first elastic band.

13. The apparatus of claim 12, the left strap being substantially inelastic, the right strap being substantially inelastic.

14. The apparatus of claim 12, the left strap having an adjustable length, the right strap having an adjustable length.

15. The apparatus of claim 12, the left strap and the right strap forming an integral unit.

16. The apparatus of claim 12, further comprising a third elastic band mechanically coupled between the left strap and the right strap, the third elastic band being less elastic than the second elastic band.

17. The apparatus of claim 12, further comprising:

a connector to mechanically connect the upper segment of the left strap to the upper segment of the right strap;

a left handle mechanically coupled to the lower segment of the left strap; and a right handle mechanically coupled to the lower segment of the right strap.

* * * * *